United States Patent [19]

Matsuda et al.

[11] Patent Number: 4,534,322

[45] Date of Patent: Aug. 13, 1985

[54] ARRANGEMENT FOR INSERTION OF SPARK PLUGS IN CYLINDER HEAD

[75] Inventors: Minoru Matsuda, Chofu; Toshiro Mitsuishi, Higashimurayama, both of Japan

[73] Assignee: Honda Giken Kogyo Kabushiki Kaisha, Tokyo, Japan

[21] Appl. No.: 537,225

[22] Filed: Sep. 29, 1983

[30] Foreign Application Priority Data

Sep. 29, 1982 [JP] Japan ..... 57-170702
Nov. 12, 1982 [JP] Japan ..... 57-198464

[51] Int. Cl.[3] ..... F02P 15/05

[52] U.S. Cl. ..... 123/55 R; 123/169 PH; 123/310; 123/195 R; 123/52 MV

[58] Field of Search ..... 123/90.31, 90.27, 169 PA, 123/169 PH, 52 MV, 52 M, 55 V, 310, 195 R, 55 R, 55 A, 55 UE, 55 VF, 55 VS

[56] References Cited

U.S. PATENT DOCUMENTS

| | | | |
|---|---|---|---|
| 1,360,958 | 11/1920 | Kline | 123/55 VF |
| 1,965,569 | 7/1934 | Anderson | 123/51 BA |
| 2,324,705 | 7/1943 | Huber | 123/310 |
| 2,428,791 | 10/1947 | Earnshaw | 123/193 CH |

FOREIGN PATENT DOCUMENTS

| | | | |
|---|---|---|---|
| 2369438 | 5/1978 | France | 123/169 PH |
| 0556790 | 10/1943 | United Kingdom | 123/169 PH |

*Primary Examiner*—Craig R. Feinberg
*Attorney, Agent, or Firm*—Pollock, Vande Sande & Priddy

[57] ABSTRACT

Arrangement for inserting a spark plug in a V-type engine cylinder head, comprising a separate sleeve surrounding the spark plug and removably insertable in the wall of the combustion chamber by screw threading. The spark plug extends through the cam chain chamber and can be removed without interference with the operation of the endless cam chain.

4 Claims, 11 Drawing Figures

ARRANGEMENT FOR INSERTION OF SPARK PLUGS IN CYLINDER HEAD

SUMMARY OF THE INVENTION

The present invention relates to a cylinder head in an engine of the V type, or one which has horizontal opposing air intake valves, with the plug installed from the cam chain chamber side.

BACKGROUND OF THE INVENTION

In a V type or horizontal opposition engine, in order to make effective use of space and to make the engine compact, cam shaft drive sprockets are normally placed at either of the two ends of the crank shaft, and the respective cam shafts are driven by means of the said sprockets and a cam chain.

Where the engine has a number of valves on the air intake side, in order to facilitate maintenance, if the spark plugs are to be installed from the cam chain side, they must of necessity be located on the exhaust valve side.

Accordingly, as shown in FIGS. 8 and 9 illustrating the prior art, in the case of a V type engine, for example, the cam chains 104, 105 which go around cam shaft drive sprockets 102, 103 at the two ends of crank shaft 101, etc., are respectively wound around secondary sprocket 107 of the front cylinder head 106 and secondary sprocket 109 of the rear cylinder head 108, so as to drive their respective cam shafts 111 and 112. With the front and rear cam shaft drive sprockets 102 and 103 fitted in reciprocally corresponding positions, with the respective cylinder heads 106 and 108 having their cam chain chamber 113 and 114 placed in mutually reversed positions, and with spark plugs 121 and 122 installed from the cam chain chamber side, in order to prevent interference involving the taut sides 104*a* and 105*a* and the slack sides 104*b* and 105*b* of the cam chains 104 and 105, respectively, the left to right angles of deviation from the central lines 106*a* and 108*a* for the respective cylinder heads 106 and 108 must be $\theta 1$ and $\theta 2$. Accordingly, the respective cylinder heads 106 and 108 must be manufactured separately, with a number of separate component parts, making it difficult to achieve cost reductions.

If the installation angles $\theta 1$ and $\theta 2$ are made equal for plugs 121 and 122, and if one attempts to use the two cylinder heads 106 and 108 together, plugs 121 and 122 will interfere with cam chains 104 and 105, respectively, so that it becomes necessary to enlarge the secondary sprockets 107 and 109. This in turn requires larger cylinder heads 106 and 108, precluding the possibility of making the engine more compact.

OBJECT OF THE INVENTION

The present invention is intended to overcome these disadvantages, by means of a pair of cylinder heads, in a V type horizontal opposition engine, which have spark plugs installed from the cam chain chamber side, bringing about compactness as well as the ability to use the two heads together.

This objective is achieved, in the present invention, by installing the plug at an oblique angle (viewed axially from the cylinder), so that the inner end of the plug rests in the air exhaust hole, and the outer end of the plug is in a position approximately in the middle section of the cam chain chamber.

BRIEF DESCRIPTION OF THE DRAWINGS

In order that the invention may be more clearly understood, reference will now be made to the accompanying drawings, wherein an embodiment of the invention is shown for purposes of illustration, and wherein.

DESCRIPTION OF PREFERRED EMBODIMENT

Figure 1:
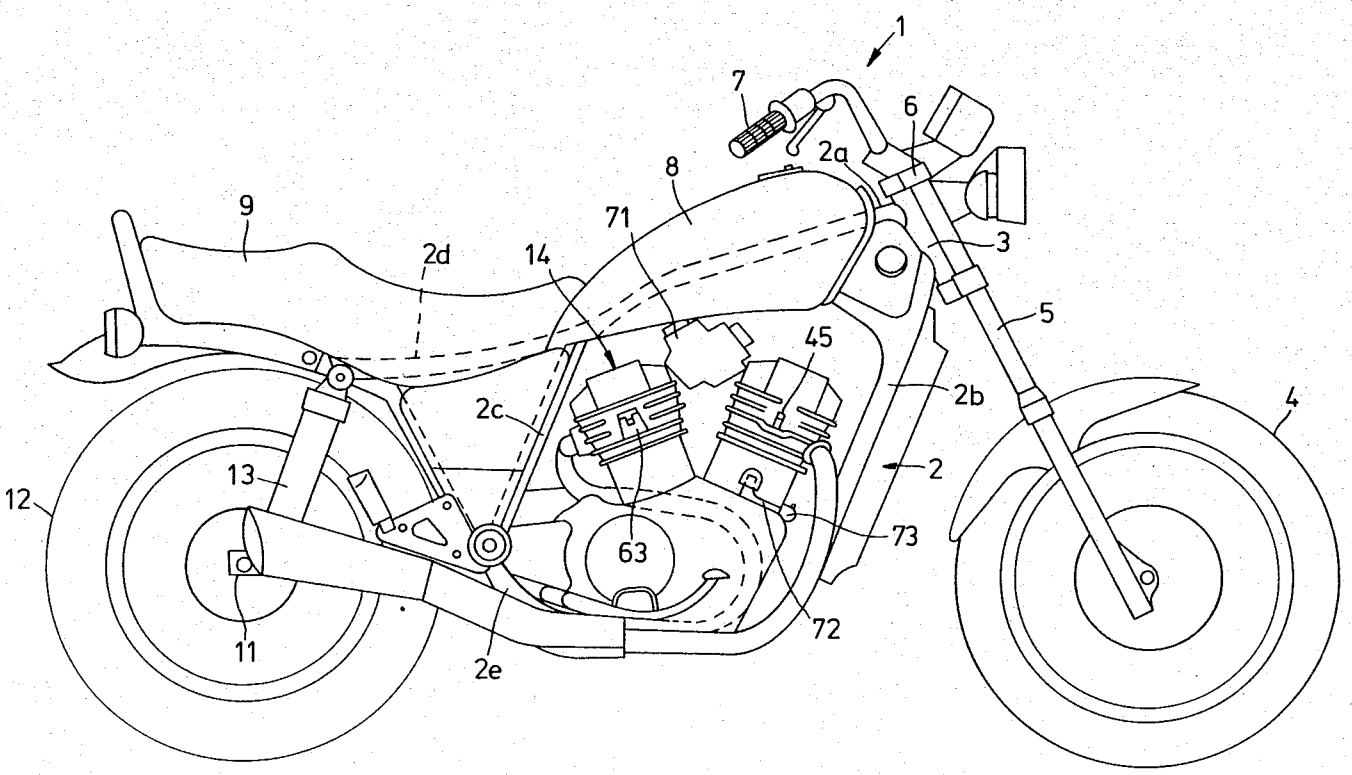
FIG. 1 is a side view of a motorcycle having a V type engine.
Figure 2:
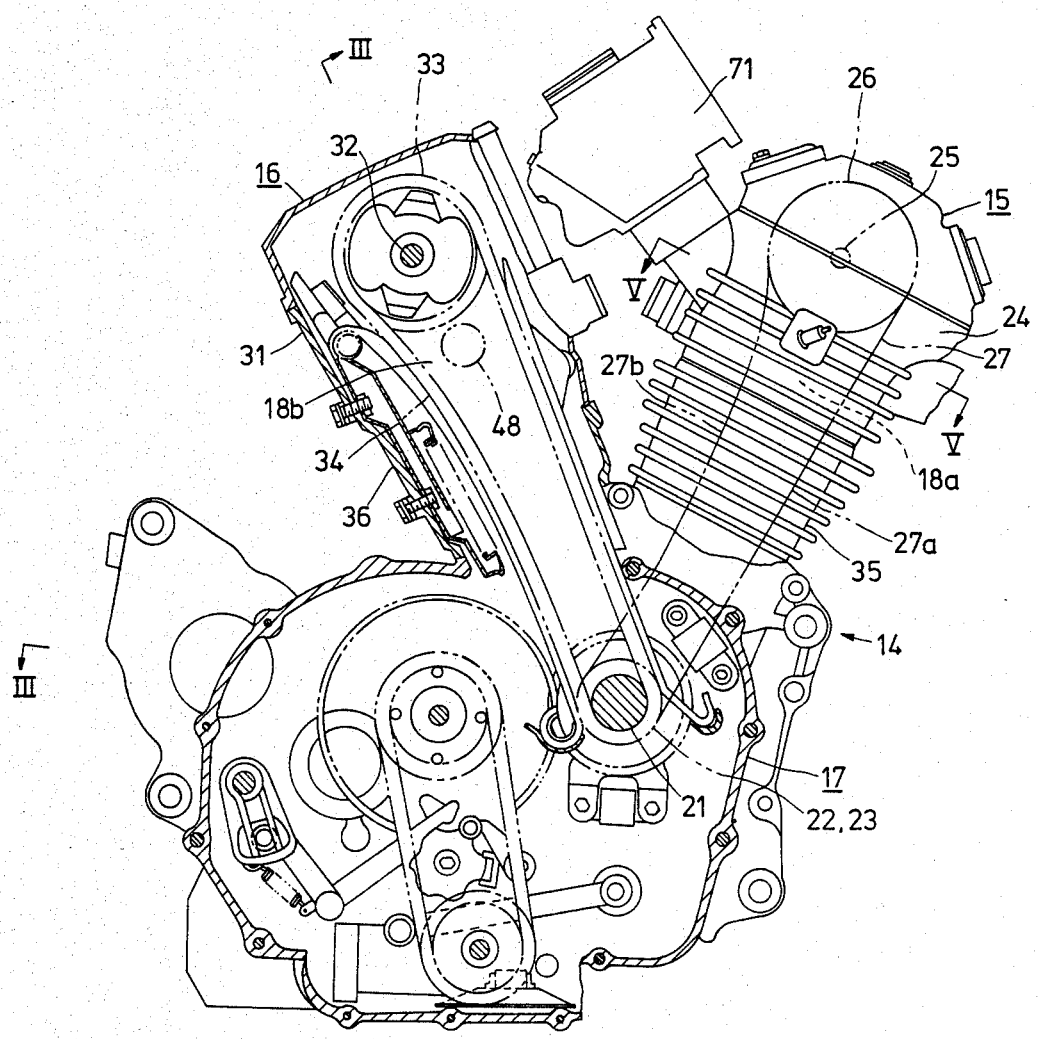
FIG. 2 is a cross section view of the main parts of the engine.
Figure 3:
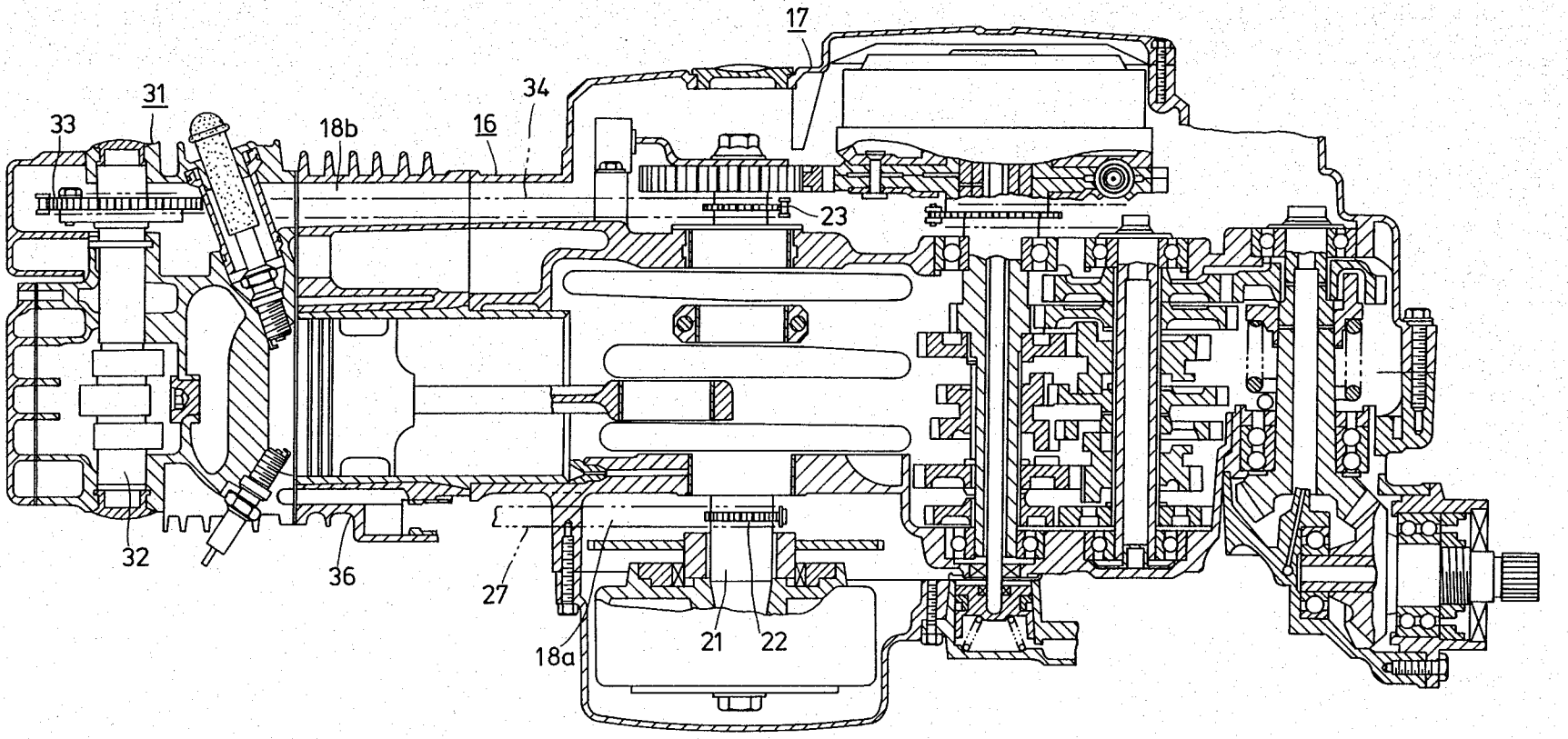
FIG. 3 is a sectional view along line III—III in FIG. 2.

As shown in FIG. 1, head tube 3 is located at the front end of the frame 2 of motorcycle 1. Front fork 5 is supported so it can operate freely by head tube 3, and it supports front wheel 4. The handle 7 is placed above top bridge 6.

The frame 2 comprises the main pipe 2*a*, extending rearwardly from the upper rear area of head tube 3; the down tube 2*b*, which extends downwardly from the lower part of head tube 3; the lower down tube 2*e*, which extends from the lower end of down tube 2*b*; center tube 2*c*, which slants up at an angle from the lower down tube 2*e*, and is connected to the rear of main pipe 2*a*; seat rail 2*d*, which extends rearwardly from main pipe 2*a*; and other parts.

As for the lower down tube 2*e*, below the down tube 2*b*, center tube 2*c*, and main pipe 2*a*, there are two of these, located to left and right. Fuel tank 8 is so located as to straddle the main pipes 2*a* of the frame 2; the seat 9 is placed on top of the seat rail 2*d*; the rear wheel 12 is supported by means of the rear fork 11 extending from the lower end of the center tube 2*c*; and the rear cushion unit 13 is placed between the rear fork 11 and the seat rail 2*d*.

Inside the space created among these parts of the frame 2, surrounded by main pipe 2*a*, down tube 2*b*, lower down tube 2*e*, and center tube 2*c*, there is placed the engine 14, shown here as a V type engine with the two cylinders at 45° angles from each other.

Engine 14 comprises front and rear cylinders 15 and 16, and crank case 17. Front cylinder 15 contains a cam chain chamber 18*a*, on the left hand side of the vehicle body, while rear cylinder 16 contains a cam chain chamber 18*b* on the right-hand side of the vehicle body. The cylinder openings of front cylinder 15 and rear cylinder 16 are distributed in offset fashion to the left and the right respectively of a center line running through the vehicle body.

Cam shaft drive sprockets 22 and 23 are respectively attached at the two ends of the crank shaft 21 placed in crank case 17. The secondary sprocket 26 of the cam shaft located at the cylinder head 24 of the front cylinder 15, and the left side cam shaft drive sprocket 22, are connected by the cam chain 27, passing through the chain chamber 18*a*. The secondary drive sprocket 33 of the cam shaft located at the cylinder head 31 of the rear cylinder 16, and the right side cam shaft drive spocket 23, are connected by the cam chain 34, passing through the chain chamber 18*b*.

The cylinder head 24 of the front cylinder 15 and the cylinder head 31 of the rear cylinder 16 have the same shape and structure, and they are respectively rotated reciprocally in a 180° plane, installed in the respective cylinder bodies 35 and 36.

Figure 6:
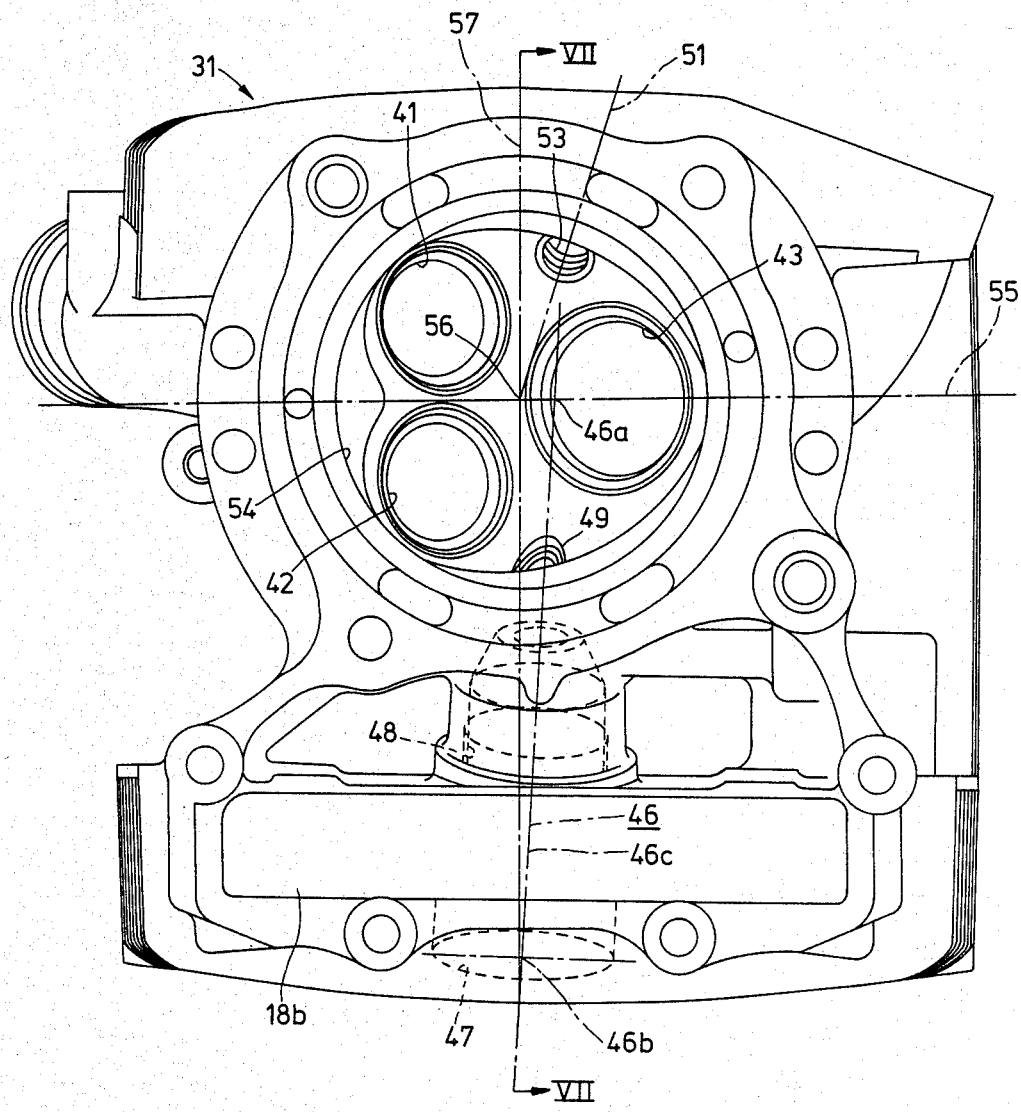
FIG. 6 is a sectional view of the cylinder head.

As shown in FIG. 6, rear cylinder 16 has two air intake holes 41 and 42, and one exhaust hole 43, formed in cylinder head 31. So that spark plugs 44 and 45 may be respectively installed from the right-hand side of cylinder head 31, i.e., from the side of cam chamber 18*b*, and from the left-hand side of cylinder head 31, there are respectively fitted, on the cam chain chamber side 18*b*, in line with axis 46, guide hole 47, sleeve screw hole 48, and plug screw hole 49; and on the left-hand side of cylinder head 31 in line with axis 51, there are respectively fitted guide hole 52 and plug screw hole 53.

Figure 7:
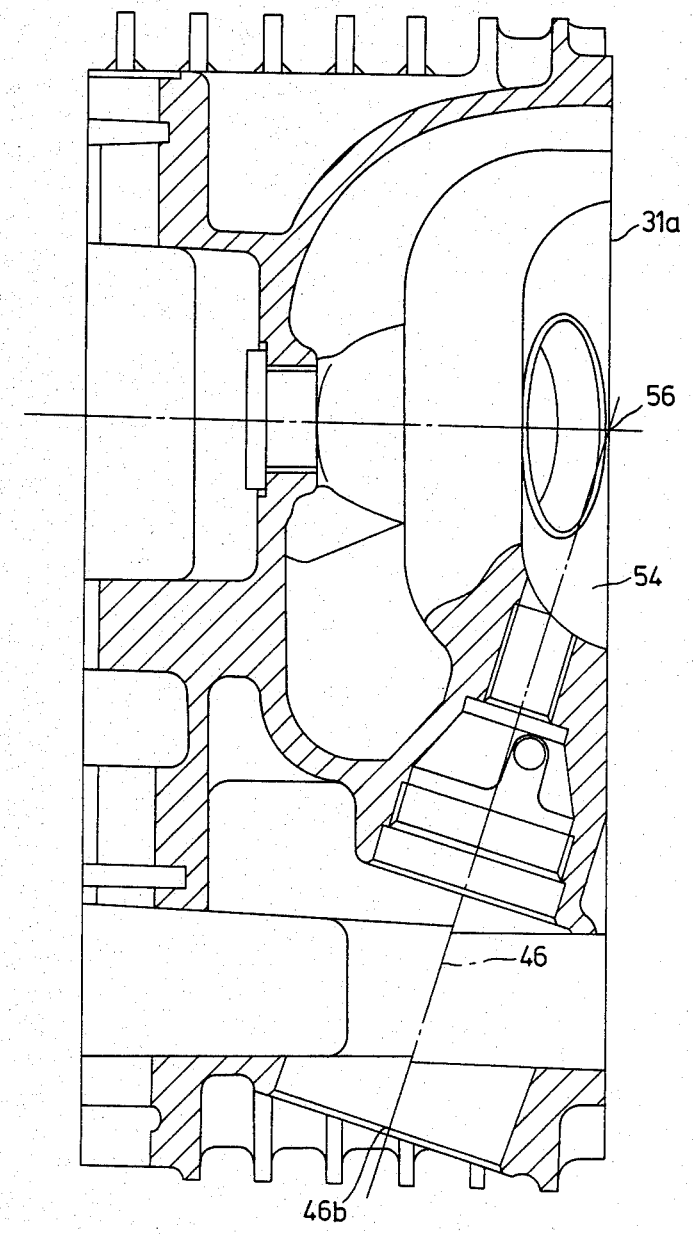
FIG. 7 is a sectional view along line VII—VII in FIG. 6.
Figure 8:
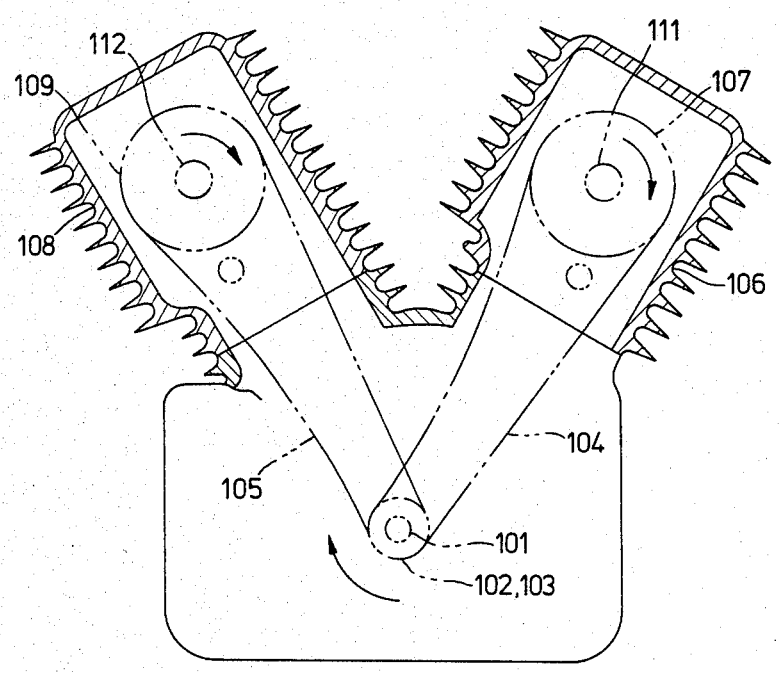
FIG. 8 is an elevation showing a prior art arrangement of the cylinder heads.
Figure 9:
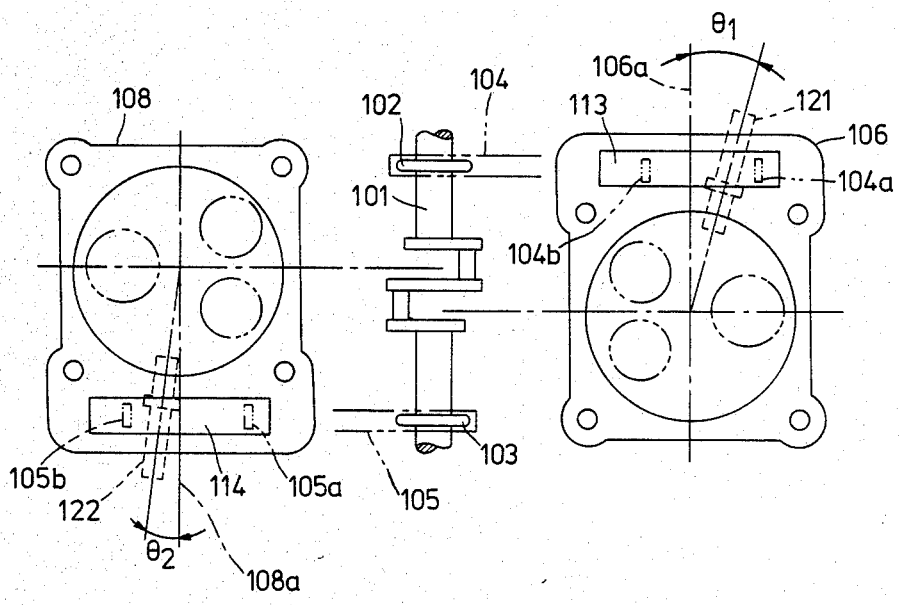
FIG. 9 is a plan view thereof.

As shown in FIG. 6, relating to cylinder head 31, there is a crossing of a line extending from axis 46 and the axial line across the combustion chamber 54, at point 46*a*. This point 46*a* is slightly inclined in the direction of exhaust hole 43, away from the center point of the combustion chamber 54. The outer end 46*b* of axis 46 is slightly inclined towards exhaust hole 43, and away from line 57, which is the central axial line of the combustion chamber 54 (this central axial line of combustion chamber 54 is approximately parallel to the crank shaft 21). Further, portion 46*c* of axis 46 which faces the cam chain chamber 18*b* is located approximately in the middle of cam chain chamber 18, lengthwise, and the fitted plug 44 is arranged in such a way that it interferes with neither the taut side 34*a* nor the slack side 34*b* of the cam chain 34. In the illustrated embodiment, the axis line 46 is inclined at an approximately 3° angle from axial line 57. In the horizontal view of cylinder head 31, shown in FIG. 7, the extension of axial line 46 approximately crosses the axis 56 of combustion chamber 54, and the outer end 46*b* of axis 46 is somewhat higher than the inner end.

The extension of axis 51, as shown in FIG. 6, if viewed vertically in terms of cylinder head 31, approximately crosses the center 56 of combustion chamber 54, and the outer end of axis 51 is inclined toward exhaust hole 43. In addition, viewed horizontally in terms of cylinder head 31, the extension of line 51 crosses 31*a* below the cylinder head at a position towards the outer end of axis 51, away from the center 56 of the combustion chamber 54. The outer end of axis 51 is located at a higher position than the inner end, and, taking into account the installation of the spark plug, axial lines 51 and 31*a* below the cylinder head extend at an angle to each other of less than 60°.

The sleeve is fitted in the above cited guide hole 47 and sleeve screw hole 48, while the plug 44 is fitted in the plug screw hole 49, with cap 62 fitted on the rear of plug 44, with the outer end of cap 62 held on the outer end of sleeve 61 by means of sealing element 63. In addition, plug 45 is fitted in the above cited guide hole 52 and plug screw hole 53.

In FIG. 1, 71 is the carburetor, 72 is the coolant tubing, and the portion of the coolant tubing 72 facing the cylinder body 35 is secured by means of rubber element 73, so as to prevent vibration of coolant tubing 72.

Figure 5:
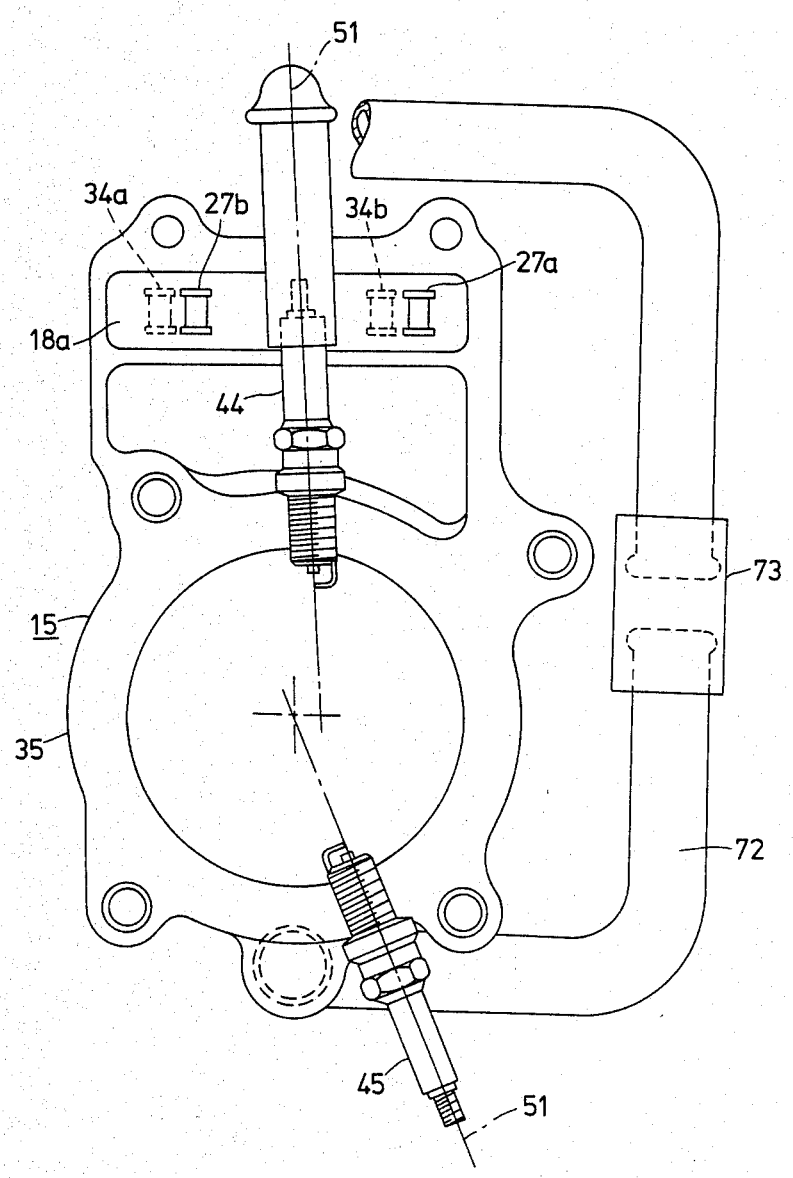
FIG. 5 is a sectional view along line V—V in FIG. 2.

The plug 44 installed from cam chain chamber side 18*b* is so placed that it is located between the taut side 34*a* and the slack side 34*b* of the cam chain 34, and so that it appropriately inclines in the direction of the taut side 34*a* or the slack side 34*b*. Consequently, as shown in FIG. 5, when cylinder head 31 is placed in front cylinder 15, plug 44 does not interfere with the taut side 27*a* or the slack side 27*b* of the cam chain 27, and when cylinder head 31 is placed in rear cylinder 16, as shown by the hypothetical lines, plug 31 does not interfere with the taut side 34*a* or the slack side 34*b* of cam chain 34. As a result, it becomes possible to make cylinder head 31 more compact, and for it to be used with both front cylinder 15 and rear cylinder 16.

Figure 4:
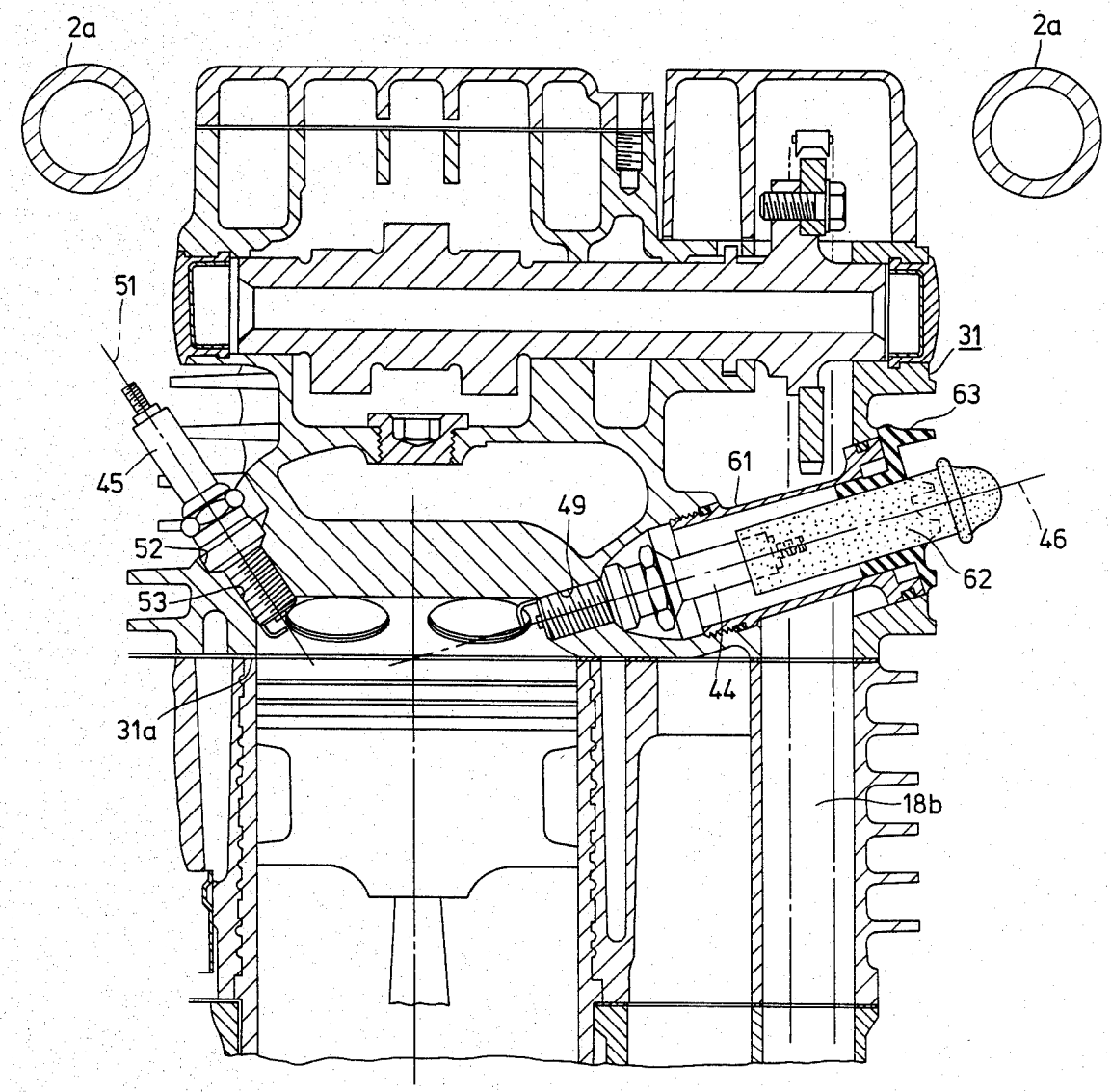
FIG. 4 is a detail view of the essential parts of FIG. 3.

During insertion and removal of the two plugs 44 and 45, as shown in FIG. 4, the tools used do not interfere with main pipes 2*a*, and operations are carried out simply and quickly.

Although the foregoing discussion specifically mentions a V type engine, the invention is also suitable for a horizontal opposition engine having plugs fitted from the cam chain chamber side. In either case, the two cylinder heads can be made more compact, and commonly used, thereby reducing the total number of parts required and contributing toward a reduction of costs. In addition, simplicity, ease and speed of plug installation are enhanced.

Figure 10:
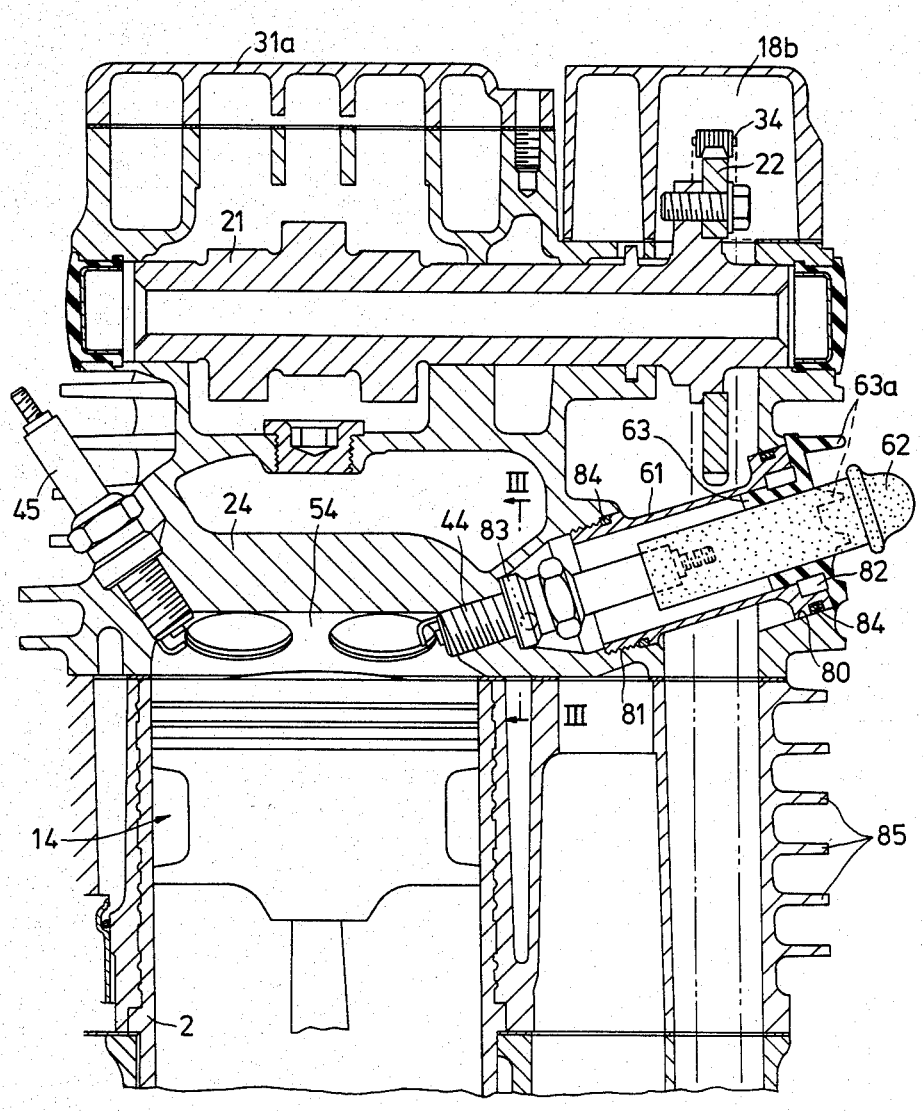
FIG. 10 is a view similar to FIG. 4, showing additional details.
Figure 11:
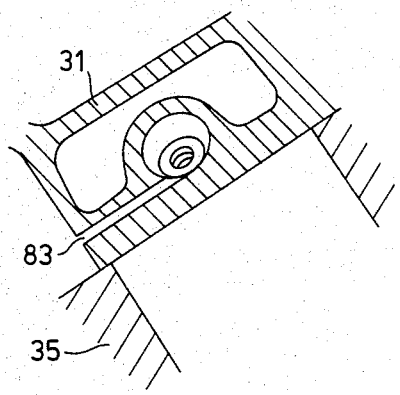
FIG. 11 is a section view along line III—III of FIG. 10.

An additional improvement provided by the present invention is shown in FIGS. 10 and 11.

While the insertion of spark plugs in the wall of the combustion chamber, passing through the cam chain chamber outside the said combustion chamber, is already known in the art, the use of a sleeve surrounding the spark plug and formed as a unit with the cylinder head, in order to prevent interference between the spark plug and the cam chain in the cam chain chamber, means that the cam chain must be arranged in joint linkage form, in a suspension and crossover movement, and such an arrangement is both complicated and inconvenient.

To overcome this problem, the present invention provides a structure in which the plug sleeve is removed from the cam chain chamber at will, and the fitting is such that during such removal the movement of the cam chain can continue. The spark plug is installed in such a fashion that it is inserted in the wall of the engine cylinder head combustion chamber, with its outer side passing through the cam chain chamber, and there is a fitting apparatus with a plug sleeve surrounding the spark plug passing through an aperture in the outer wall of the cam chain chamber, to permit insertion and removal at will.

As shown in FIG. 10, this improvement applies to a V-type engine 14 carried on a two-wheeled motor vehicle. On one side of the combustion chamber 54 of each cylinder head 24; 31, fitted on the top of each of the pair of cylinder blocks 35, 36 installed in such a fashion as to slope in the front and rear directions in the form of a V, as the first spark plug 44 is inserted through the outer cam chain chamber 18*b*, on the other side of combustion chamber 54 the second spark plug 45 is inserted so as to protrude directly out of cylinder head 24.

In FIG. 10, 21 identifies the cam shaft, located between the said head 31 and the head cover 31*a* above it, and the cam chain 34 moves through cam chain chamber 18*b*, between the sprocket 22 at the end of cam shaft 21 and sprocket 23 on top of the crank shaft (not shown).

61 identifies the sleeve surrounding the first spark plug 44, and this sleeve 61, in accordance with a special feature of the invention, passes through an opening 80 in the outer wall of cam chain chamber 18*b*, and is so made to fit in, and to be inserted and removed at will from the receiving opening 81 in the outer surface of the wall of combustion chamber 54. At the same time that sleeve 61 fits into opening 80 and receiving opening 81, in a liquid seal, its inner and outer ends, respectively, through O-rings 84, the tip of the inner end being screwed into the receiving opening 81, and the outer end having around it a fitting 82 for sleeve rotation, so that sleeve 61 can be inserted and removed.

The receiving opening 81 is formed so as to have a smaller diameter than opening 80, and the O-ring 84 around the inner end of sleeve 61 is correspondingly smaller in diameter; insertion and removal of sleeve 61 is facilitated by O-ring 84 freely placed around opening 80, so as to facilitate assembly. In addition, at the bottom area of receiving opening 81, as shown in FIG. 11, there is a water drain hole 83 protruding at the pitch of the slope of its respective cylinder block, so as to evacuate rain water and the like that might temporarily enter sleeve 61, draining out through the said water drain hole 83.

63 identifies a rubber cap placed over the outer part of sleeve 61; by means of a cap 63, plug cap 62 is placed so as to cover spark plug 44; in addition, fin area 63*a* on the outer surface of cap 63 is connected with the cylinder fins 85 to serve as a guide when cap 63 is mounted.

The operation of the improvement illustrated in FIGS. 10 and 11 is as follows. After movement of cam chain 34 has been phased in, spark plug 44 and sleeve 61 are placed through the opening 80 of the outer wall of cam chain chamber 18*b*. Since removal of sleeve 61 proceeds in a similar manner, it is possible to move along cam chain 34, operational characteristics are improved, and it is also possible to use an endless type of cam chain 34, which has greater durability than the joint linked type chain previously used.

In addition, while the engine is in operation, even when there is oscillation, e.g., due to slackness of cam chain 34 or other factors, spark plug 44 is protected by sleeve 61 from cam chain 34, there is no damage due to interference from chain 34, and, in addition, the entry of oil and other foreign matter is blocked.

Thus, according to the present invention, when a spark plug is fitted in the cam chain chamber side of the combustion chamber wall of the cylinder head, the plug sleeve required is a unit separate from the cylinder head, and may be removed as desired through the opening formed in the outer wall of the cam chain chamber. It is possible to move the cam chain along while the said sleeve is taken out; an endless type chain may be used as the cam chain; and the sleeve may be lighter and less thick than was necessary when it was unitary with the cylinder head, thus permitting size and weight reduction of the engine.

What is claimed is:

1. Arrangement for inserting a spark plug in an engine cylinder head comprising a combustion chamber having a wall, a cam chain chamber having a wall and an endless cam chain within said chamber, said arrangement comprising (a) a first opening in said wall of said cam chain chamber for inserting said spark plug with its outer end extending through said cam chain chamber;

(b) screw threaded second opening having a smaller diameter than said first opening, in said wall of said combustion chamber;

(c) a separate sleeve surrounding said spark plug inserted through said first opening, said sleeve being screw threaded at its inner end encircled by said cam chain;

(d) means for screwing and unscrewing said sleeve into engagement with said second opening; and (e) means for sealing the ends of said sleeve against leakage of oil.

2. Arrangement according to claim 1, comprising at least one spark plug installed at an oblique angle, the inner end of said plug being positioned in an air exhaust hole, while the outer end of said plug is located in a middle section of said cam chain chamber.

3. Arrangement according to claim 1, comprising two engine cylinder heads a V-type engine, each head comprising its own cam chain chamber, one of said cylinder heads being a front cylinder head, having two air intake openings and an exhaust opening, and another of said cylinder heads being a rear cylinder head and a pair of spark plugs each installed from a side of a respective one of said cam chain chambers, whereby both of said cylinder heads can be used together.

4. Arrangement according to claim 3, comprising at least one spark plug installed at an oblique angle on each cylinder head, the inner end of said plug being positioned in an air exhaust hole, while the outer end of said plug is located in a middle section of said cam chain chamber.

* * * * *